US005407601A

United States Patent [19]

Furey et al.

[11] Patent Number: 5,407,601

[45] Date of Patent: Apr. 18, 1995

[54] COMPOSITIONS FOR REDUCING WEAR ON CERAMIC SURFACES

[75] Inventors: Michael J. Furey, Blacksburg, Va.; Czeslaw Kajdas, Plock, Poland

[73] Assignee: Center For Innovative Technology, Herndon, Va.

[21] Appl. No.: 22,741

[22] Filed: Feb. 17, 1993

Related U.S. Application Data

[63] Continuation of Ser. No. 604,771, Oct. 26, 1990, abandoned.

[51] Int. Cl.[6] ..... C10M 105/68; C10M 105/80

[52] U.S. Cl. ..... 252/51.5 A; 252/25; 252/49.7; 252/52 R; 252/56 D; 252/56 S; 501/134; 501/153; 501/154

[58] Field of Search ..... 252/56 R, 56 D, 56 S, 252/52 R, 12, 12.2, 515 A, 286, 49.9, 49.5; 585/10, 12, 18; 106/46; 501/134, 153, 154

[56] References Cited

U.S. PATENT DOCUMENTS

| | | | |
|---|---|---|---|
| 3,114,708 | 12/1963 | Morway et al. | 252/12 |
| 3,180,832 | 4/1965 | Furey | 252/56 S |
| 3,273,981 | 9/1966 | Furey | 252/56 R |
| 3,287,273 | 11/1966 | Furey et al. | 252/57 |
| 3,429,817 | 2/1969 | Furey et al. . | |
| 3,516,933 | 6/1970 | Andrews | 252/12 |
| 3,827,892 | 8/1973 | McCauley | 252/12 |
| 4,462,920 | 7/1984 | Synder et al. | 252/49.5 |
| 4,469,611 | 9/1984 | Synder et al. | 252/49.5 |
| 4,497,720 | 2/1985 | Moriga et al. | 252/32 A |
| 4,543,390 | 9/1985 | Tanaka et al. | 525/63 |
| 4,551,396 | 11/1985 | Wiegard et al. | 252/25 |
| 4,650,592 | 3/1987 | Dobbs et al. | 252/12.2 |
| 4,826,612 | 5/1989 | Habeeb et al. | 252/52 R |
| 5,122,502 | 6/1992 | Bowman et al. | 503/227 |

OTHER PUBLICATIONS

Furey, "The Formation of Polymeric Fils Directly on Rubbing Surfaces to Reduce Wear", Wear, vol. 26, (1973), pp. 369–392 (no month).

Furey, "The In Situ Formation of Polymeric Films on Rubbing Surfaces", Proc. Int. Colloq., Polymers and Lubrication, Brest, Centre National de la Recherche Scientifique, Paric, No. 233 (1975), pp. 393–404 (no month).

Furey et al., "Thermal and Catalytic Effects on Tribopolymerization as a New Boundary Lubrication Mechanism", Wear, vol. 136 (1990), pp. 85–97. (no month).

*Primary Examiner*—Margaret Medley

*Attorney, Agent, or Firm*—Whitham, Curtis, Whitham & McGinn

[57] ABSTRACT

Fluid compositions comprised of a monomer constituent dissolved in a carrier fluid, where the monomer constituent is capable of forming a polymer film directly on rubbing surfaces but is not polymerized in solution, have been found to be effective for reducing ceramic wear.

8 Claims, 15 Drawing Sheets

| Additive in Hexadecane For Alumina-on-Alumina System | Structure | Concentration in solution | Wear ($10^{-3}mm^3$) Disk | Ball | Total | % Wear Reduction |
|---|---|---|---|---|---|---|
| methyl-2-acrylamido-2-methoxyacetate |  | 0.02 % | 48 | 36 | 84 | 82 % |
| | | 0.10 % | 73 | 23 | 96 | 80 % |
| | | 1.00 % | 85 | 40 | 125 | 73 % |

| Additive in Hexadecane For Alumina-on-Alumina System | Structure $CH_2=CHX$ (where Xis) | Wear ($10^{-3}mm^3$) Disk | + Ball | = Total | % Wear Reduction |
|---|---|---|---|---|---|
| 1-dodecene | $-(CH_2)_9CH_3$ | 190 | 57 | 247 | 47 % |
| 1-tetradecene | $-(CH_2)_{11}CH_3$ | 343 | 150 | 493 | [5% INCREASE] |
| 1-hexadececne | $-(CH_2)_{13}CH_3$ | 170 | 93 | 263 | 44 % |
| 1-octadecene | $-(CH_2)_{15}CH_3$ | 157 | 67 | 224 | 48 % |
| 1-eicosene | $-(CH_2)_{17}CH_3$ | – | – | [est. 440]* | No Effect |

* at 300m, very noisy
D = 168, P = 96, D X P= 264 @ 300m.
EST 440 @ 500m

FIG.6A

| Additive in Hexadecane For Alumina-on-Alumina System | Structure $CH_2$=CHX (where Xis) | Wear ($10^{-3}mm^3$) Disk | + Ball | = Total | % Wear Reduction |
|---|---|---|---|---|---|
| Styrene |  | 138 | 95 | 233 | 50 % |
| 4-methyl styrene |  | 220 | 83 | 303 | 35 % |
| 4-vinylbiphenyl |  | 125 | 88 | 213 | 55 % |
| 2-vinylnaphthalene |  | 176 | 70 | 216 | 48 % |
| 9-vinylanthracene |  | 230 | 97 | 327 | 30 % |

| Additive in Hexadecane For Alumina-on-Alumina System | Structure $CH_2=CHX$ (where X is) | Wear ($10^{-3}mm^3$) Disk | + Ball | = Total | % Wear Reduction |
|---|---|---|---|---|---|
| n-butyl methacrylate | $-C(=O)-O-(CH_2)_3CH_3$ | 95 | 45 | 140 | 70 % |
| lauryl methacrylate | $-C(=O)-O-(CH_2)_{11}CH_3$ | 74 | 51 | 125 | 73 % |
| n-octadecyl methacrylate | $-C(=O)-O-(CH_2)_{17}CH_3$ | 220 | 77 | 297 | 37 % |
| iso-decyl acrylate | $-C(=O)-O_{150}C_{10}H_{21}$ | 107 | 47 | 154 | 67 % |

FIG.6C

| Additive in Hexadecane For Alumina-on-Alumina System | Structure $CH_2=CHX$ (where X is) | Wear ($10^{-3}mm^3$) Disk | + Ball | = Total | % Wear Reduction |
|---|---|---|---|---|---|
| Vinyl acetate | $-O-C(=O)-CH_3$ | 83 | 57 | 140 | 70 % |
| Vinyl 2-ethylhexaniate | $-O-C(=O)-CH(CH_2)_2-CH_3-CH_3$ | 135 | 67 | 202 | 57 % |
| Vinyl stearate | $-O-C(=O)-O-(CH_2)_{16}CH_3$ | 141 | 63 | 204 | 56 % |
| Vinyl octadecyl ether | $-O-(CH_2)_{17}CH_3$ | 57 | 63 | 120 | 74 % |
| acrylamide | $-C(=O)-NH_2$ | 380 | 165 | 545 | [16 % increase] |

FIG.6D

| Additive in Hexadecane For Alumina-on-Alumina System | Structure $CH_2=CHX$ (where X is) | Wear ($10^{-3}mm^3$) Disk | + Ball | = Total | % Wear Reduction |
|---|---|---|---|---|---|
| Vinyl cycleoctane |  | 188 | 106 | 294 | 37 % |
| Vinyl ferrocene |  | 205 | 75 | 280 | 40 % |

| Additive in Hexadecane For Alumina-on-Alumina System | Structure $CH_2=CH-X-CH_2$ (where X is) | Wear ($10^{-3}mm^3$) Disk | Ball | Total | % Wear Reduction |
|---|---|---|---|---|---|
| diallyl phthalate |  | 147 | 57 | 204 | 57 % |
| diallyl succinate |  | 116 | 67 | 183 | 61 % |

| Additive in Hexadecane For Alumina-on-Alumina System | Structure XCH=CHY | Wear ($10^{-3}mm^3$) Disk | + Ball | = Total | % Wear Reduction |
|---|---|---|---|---|---|
| trans β-methylstyrene | X = $-CH_3$<br>Y =  | 490 | 147 | 637 | [36 % increase] |
| Cis-H-hexadecene-1-Yl-acetate | X = $-(CH_2)_{10}-C(=O)OCH_3$<br>Y = $-(CH_2)_3CH_3$ | 134 | 82 | 216 | 54 % |
| Cis-H-hexadecene-l l-ol | X = $-(CH_2)_3CH_3$<br>Y = $-(CH_2)_{18}OH$ | | | | 43 % |
| oleyl alchohol | X = $-(CH_2)_7CH_3$<br>Y = $-(CH_2)_8OH$ | | | | 45 % |

| Additive in Hexadecane For Alumina-on-Alumina System | Structure $CH_2=CXY$ | Wear ($10^{-3}mm^3$) Disk | Ball | Total | % Wear Reduction |
|---|---|---|---|---|---|
| 1, 1-diphenylethylene | X =  Y =  | 196 | 96 | 292 | 38 % |
| α-methylstyrene | X = $-CH_3$ Y =  | 230 | 116 | 346 | 26 % |
| methacrylamide | X =  Y = $-CH_3$ | 330 | 151 | 481 | [2 % increase] No significant effect |

| Additive in Hexadecane For Alumina-on-Alumina System | Structure | Concentration in solution | Wear ($10^{-3}mm^3$) Disk | Ball | Total | % Wear Reduction |
|---|---|---|---|---|---|---|
| methyl-2-acrylamido-2-methaxyacetate |  | 0.02 % | 48 | 36 | 84 | 82 % |
| | | 0.10 % | 73 | 23 | 96 | 80 % |
| | | 1.00 % | 85 | 40 | 125 | 73 % |

| Additive in Hexadecane For Alumina-on-Alumina System | Structure of additive | Applied Load | Wear ($10^{-3}mm^3$) Disk | Ball | Total | % Wear Reduction |
|---|---|---|---|---|---|---|
| None | – | 5 | 81 | 68 | 149 | – |
| | | 10 | 102 | 88 | 190 | – |
| | | 20 | 350 | 109 | 459 | – |
| 1 % monoesler of $C_{36}$ dimer acid and ethylene glycol | $Ho-\overset{O}{\overset{\|\|}{C}}-R-CH$ (where R contains 38 carbon atoms) | 5 | 68 | 52 | 120 | 19 % |
| | | 10 | 85 | 71 | 156 | 18 % |
| | | 20 | 197 | 45 | 242 | 48 % |

FIG.8A

| ADDITIVE IN HEXADECANE FOR ZIRCONIA-ON-ZIRCONIA SYSTEM | AVERAGE BALL WEAR ($10^{-3}$ $mm^3$) | % WEAR REDUCTION |
|---|---|---|
| 1% $C_{36}$ dimer acid/ ethylene glycol monoester | 1.11 | 36 |
| 1% amino undecanoic acid | 1.23 | 29 |
| 1% 1-dodecene | 1.41 | 18 |
| 1% 1-elcosene | 1.39 | 20 |
| 1% lauryl methacrylate | 0.95 | 45 |
| 1% diallyl phthalate | 1.11 | 36 |
| 1% vinyl octadecyl ether | 0.95 | 45 |

FIG.9

| ADDITIVE IN HEXADECANE FOR $Si_3N_4$-on-$Si_3N_4$ SYSTEM | AVERAGE BALL WEAR ($10^{-3}$ $mm^3$) | % WEAR REDUCTION |
|---|---|---|
| 1% lauryl methacrylate | 1.113 | No effect |
| 1% diallyl phthalate | 0.549 | 51 |
| 1% 1-dodecene | 1.013 | No effect |
| 1% 11-amino undecanoic acid | 0.591 | 47 |
| 1% $C_{36}$ dimer acid/ ethylene glycol monoester | 0.316 | 72 |
| 1% methyl-2-acryloamido-2-methoxy acetate | | 65 |
| vinyl octadecyl ether | | No effect |
| vinyl acetate | | No effect |
| styrene | | No effect |

FIG.10

Effect of $C_{36}$ Dimer Acid/Ethylene Glycol Monoester and Applied Load on Fretting Wear System: Zirconia on graphite-epoxy
Frequency: 50 Hz Amplitude: 200 _m
Time: 1 hour

| Normal Load (N) | Average Disk Wear Volume ($10^{-13}$ $m^3$) | | % Reduction in Wear by Monoester |
|---|---|---|---|
| | Hexadecane | Hexadecane + 1% Monoester | |
| 40 | 4.35 | 3.42 | 21 |
| 90 | 14.63 | 8.80 | 40 |
| 130 | 31.32 | 16.36 | 48 |

FIG. 11

COMPOSITIONS FOR REDUCING WEAR ON CERAMIC SURFACES

CROSS-REFERENCE TO RELATED APPLICATIONS

This patent application is a continuation of the patent application having Ser. No. 07/604,771, filed Oct. 26, 1990, now abandoned. The complete contents of the patent application having Ser. No. 07/604,771 is incorporated by reference.

BACKGROUND OF THE INVENTION

1. Field of the Invention

The subject invention is generally directed to anti-wear additives and fluid compositions containing anti-wear additives which can effectively reduce wear in ceramic systems and, more particularly, to utilizing monomer compounds that are capable of polymerizing directly on rubbing surfaces under tribological conditions and function as anti-wear additives.

2. Description of the Prior Art

Recently there has been much interest in using ceramic materials in a wide variety of applications which traditionally have utilized metals. Ceramic materials have several advantageous engineering properties. For example, ceramics generally have high hardness, high melting points, low density, low thermal expansion, corrosion resistance, and high resistance to thermal and chemical stresses. Particular ceramic materials which are currently being used or considered for use in tribological applications include the following: alumina (aluminum oxide or $Al_2O_3$), zirconia (zirconium oxide or $ZrO_2$), silicon nitride ($Si_3N_4$), silicon carbide (SIC), boron nitride (BN), aluminum nitride (AlN), boron carbide ($B_4C$), and beryllia (beryllium oxide BeO). It is envisioned that ceramics will provide useful solutions in advanced propulsion systems, low heat rejection engines, aerospace bearings, turbomachinery, adiabatic diesel engines, high speed roller bearings in gas turbine engines, as well as a wide variety of other systems.

Wear has been defined as the progressive loss of a substance from the operating surface of a body as a result of relative motion at the surface of the body (see, Furey, "Tribology", *Encyclopedia of Materials Science & Engineering*, Pergamon Press, Oxford, pp. 5145–5157, 1986). When ceramic elements rub together or when a ceramic element rubs against an element made from a different material such as a metal or composite element, wear occurs. The rate of wear tends to increase under harsh temperature and pressure conditions which exist inside ceramic engines, propulsion systems, and the like. In addition to limiting the useful life of the part in which the ceramic is used, wear of ceramics can be costly because the ceramic materials themselves are expensive to produce.

In the prior art, basically four different approaches to lubricating ceramics have been investigated. In the first approach, various materials such as oils, additives, polymers, solid lubricants, and soaps, have been incorporated into ceramics prior to manufacturing the ceramic element so that the resulting ceramic element has a "self-lubricating" property. Since this approach requires incorporation of the materials into the ceramic prior to formation of the ceramic element, it is not useful as a lubrication scheme for lubricating existing state-of-the-art bearings or other components. Moreover, when incorporating the additives into the ceramic, the physical changes to the ceramic produced relative to the ceramic without the additives must be considered. In the second approach, the ceramic elements have been subjected to various surface treatments such as ion sputtering and implantation, or the ceramic elements have had various coatings applied thereto such as metal films, solid lubricants, and polymer films. A particular disadvantage of these surface treatments and film coatings is that they are themselves removed by wear. Hence, surface treatments and film coatings have a finite life and are non-replenishing. In a third approach, conventional soluble anti-wear additives have been added to a fluid carrier (e.g., mineral oil). This approach typically requires a specific reaction with a metal surface to form a low shear film such as iron phosphate, iron sulfide, or iron compounds of unknown composition; therefore, this approach would not be expected to be applicable to the less chemically reactive ceramic materials. In the fourth approach, dispersed solid lubricants such as graphite or molybdenum disulfide in oils have been applied to the ceramic surface. These dispersions have not yielded satisfactory results for a variety of reasons including the fact that high concentrations of the dispersion are generally needed and settling of the dispersion and filter plugging occurs.

In short, none of the four approaches discussed above have been very successful in lubricating ceramics and a new approach to reducing ceramic wear which overcomes the difficulties of the prior art would be most beneficial.

SUMMARY OF THE INVENTION

It is therefore an object of the present invention to provide novel compositions for protecting ceramic components from excessive wear.

It is another object of the present invention to use monomer compounds that are capable of polymerizing under tribological conditions as anti-wear additives for ceramic systems.

It is a still further object of the present invention to provide a method of protecting ceramic systems from excessive wear by providing an anti-wear additive or a fluid composition containing an anti-wear additive, where the anti-wear additive is a monomer compound capable of polymerizing under tribological conditions on the ceramic material in the ceramic system during high wear conditions.

According to the invention, experiments have been conducted which show that fluid compositions containing monomers which are capable of forming polymers significantly reduce the amount of wear experienced by ceramic elements that are subjected to adverse tribological conditions, such as high temperature, pressure, and friction. In the experiments, rubbing ceramic elements were continuously lubricated with a fluid composition containing a very low weight percentage of a monomer compound and a very high weight percentage of a carrier fluid and the effect which the fluid composition had on the wear of the rubbing ceramic elements relative to the effect which the carrier fluid alone had on the wear of the rubbing ceramic elements was compared. Reductions in ceramic wear were, therefore, directly attributable to the presence of the monomer compound in the carrier fluid.

In the experiments, specific ceramic-on-ceramic systems, such as alumina-on-alumina, zirconia-on-zirconia and silicon nitride-on-silicon nitride, were shown to experience reductions in wear when lubricated with compositions containing minor amounts of monomer compounds which are capable of polymerization. While the mechanism by which the monomers reduce ceramic wear is not precisely known, there is positive evidence of polymer film formation "in situ" on the surfaces of elements which rub against one another. Tribopolymerization, a term coined by the applicants to describe the "in situ" polymerization of the monomer compounds, may be initiated by high surface temperatures, catalysis, exoelectron emission, and possibly high pressures. The polymer films formed "in situ" are quite thin and do not form in the bulk carrier fluid nor do they form in non-contacting regions of the rubbing surfaces. Rather, the polymer films only form where they are most needed, i.e., the regions experiencing the most severe contact and wear, and they are continuously and simultaneously worn away and reformed under tribological conditions. Therefore, the wear reduction results shown by the experiments would very likely be achieved in other ceramic-on-ceramic systems such as those including silicon carbide, boron nitride, aluminum nitride, boron carbide, and beryllia, and would also be achieved in ceramic-on-metal and ceramic-on-composite systems, since the key protecting feature conferred by the fluid composition is the "in situ" polymerization of monomers adsorbed on the surface of the ceramic element under tribological conditions.

In the experiments, the monomers were either dissolved, partly dissolved, or dispersed in hexadecane which acted as the carrier fluid. As pointed out above, the carrier fluid itself will act as a lubricant and will help reduce friction relative to a dry ceramic system; however, the experiments performed were designed such that the wear reducing properties observed were directly attributable to the presence of the monomer compound in the carrier fluid. The function of the carrier fluid, of course, is to get the monomer compounds onto the surface of the ceramic element. Therefore, any suitable carrier fluid, such as a mineral oil, a hydrocarbon fuel, a synthetic oil, or even air where the monomers are applied to the ceramic as a vapor, is deemed to be within the scope of the present invention. Obviously, one would select carrier fluids of proper volatility, boiling point, chemical reactivity, etc., for the specific application. In most of the experiments, the monomers only comprised one percent by weight of the fluid composition. To avoid adversely affecting other properties of the fluid composition and as a matter of cost, the concentration of the monomer compounds in the fluid composition should probably be limited to a working range of 0.01–10.00%; however, the inventors do anticipate there will be some situations in which a pure 100% monomer composition might be preferred for antiwear properties. The experiments discussed below show striking anti-wear effects at low concentrations ranging from 0.1 to 1.0% by weight.

From the experimental results it can be inferred that the monomer compounds in the fluid composition may, in principle, have any chemical structure and may contain carbon, hydrogen, oxygen, nitrogen, phosphorus, sulfur, boron, metals, and other elements. An essential requirement is that the monomer compounds are capable of forming localized surface polymers; they are not polymerized in advance nor in solution. It also appears that the ability of the monomers to be adsorbed on one or both solid contacting surfaces in the ceramic system which is subjected to tribological conditions could be important in the monomer's ability to reduce ceramic wear. Adsorption is a process by which monomer is concentrated at the ceramic surface and it is likely that physisorption and chemisorption could be involved. Two important classes of monomer compounds were investigated and include, first, monomers that can form polymers by condensation type reactions and, second, monomers that can form polymers by addition type reactions.

Examples of monomer compounds in the condensation category involve polymerizable reactants of the AA and BB type or the AB type, in which polymerization is represented according to Equations 1 and 2:

$$nAA + nBB \rightarrow \left[AA - BB\right]_n + 2nC \qquad \text{Eq. 1}$$

$$nAB \rightarrow \left[A-B\right]_n + 2nC \qquad \text{Eq. 2}$$

Examples of polycondensation polymers include polyesters, polyamides, polyureas, polyanhydrides, polythioethers, polysulfonamides, polyurethanes, polyphenyl esters, copolymers, and polymers formed by ring-opening polymerization. Particularly suitable candidates of monomers that undergo polycondensation reactions within the scope of this invention are those of the alpha-omega category and react according to Equation 3:

$$nA-R-B \rightarrow \left[A-R-B\right]_n + nC \qquad \text{Eq. 3}$$

where A is a hydroxy or amino group, B is a carboxylic acid group or its methyl ester, and R is a chain of carbon atoms four to forty in number which can include aromatic, cyclic aliphatic, aliphatic and branched chain groups as well as nitrogen, phosphorus, boron, metals, and other elements. The key feature of the alpha-omega monomers is that the reactive groups, A and-B, are at opposite ends of the molecule. Orientation of the reactive groups at the ends of the molecule avoids steric hindrance problems that may interfere with adsorption and subsequent tribopolymerization on the ceramic surface, etc. It is also anticipated that mixtures of monomers which can form polymers by a polycondensation reaction are within the scope of this invention and a typical reaction scheme is presented below as Equation 4:

$$A-R_1-A + B-R_2-B \rightarrow \left[A-R_1-A-B-R_2-B\right]_n + nC \qquad \text{Eq. 4}$$

where $R_1$ and $R_2$ may be aliphatic chains of different lengths, i.e., one short and one long.

Monomer compounds in the addition category include an unsaturated ethylenic unit such as that shown below in Equation 5:

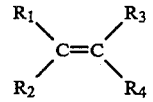

Eq. 5 where the R groups are either hydrogen or some other group. Particularly effective monomers for reducing ceramic wear are those in which $R_1=R_2=R_3=H$ with $R_4$ being an aliphatic, aromatic, cyclic, or some other group. Having only one non-hydrogen group may avoid steric hindrance problems and favor surface polymerization. The addition polymerization of a typical monomer is represented by Equation 6:

$$nCH_2{=}CHR \rightarrow \left[ CH_2{-}CHR \right]_n \quad \text{Eq. 6}$$

Examples of addition polymers include polystyrene, polyvinyl chloride, polyacrylonitrile, polyvinyl acetate, polyvinyl alcohol, polymethyl methacrylate, polyethylene, polytetrafluoroethylene, various copolymers, and analogs of these polymers formed from higher molecular weight polymers.

The ability to reduce ceramic wear should allow less expensive ceramics to be substituted for more expensive ceramics in some ceramic systems. For example, the reduced wear experienced by alumina components when a fluid composition containing monomer compounds capable of polymerization is used as a lubricant may allow the use of alumina in systems which typically have required silicon nitride (a ceramic which is known for its inherent anti-wear properties). Since alumina is far less expensive to produce than silicon nitride, the wear reducing capability of the proposed fluid compositions is believed to be extremely significant.

BRIEF DESCRIPTION OF THE DRAWINGS

The foregoing and other objects, aspects and advantages will be better understood from the following detailed description of a preferred embodiment of the invention with reference to the drawings, in which:

FIGS. 6*a* through 6*h* are tables showing the experimental results for various groups of monomer compositions in alumina-on-alumina pin-on-disk experiments;

FIG. 8*a* is a table showing the experimental results for alumina-on-alumina pin-on-disk experiments wherein a one percent by weight solution of the monoester of $C_{36}$ dimer acid and ethylene glycol dissolved in hexadecane is used as the lubricant and different loads are applied;

FIG. 9 is a table showing the experimental results for zirconia-on-zirconia pin-on-disk experiments wherein one percent by weight mixtures of various monomers dissolved in hexadecane were used as the lubricant;

FIG. 10 is a table showing the experimental results for silicon nitride-on-silicon nitride pin-on-disk experiments wherein one percent by weight mixtures of various monomers dissolved in hexadecane were used as the lubricant; and FIG. 11 is a table showing the experimental results for fretting wear tests where hexadecane and hexadecane and one percent by weight of the $C_{36}$ dimer acid and ethylene glycol monoester are used as the lubricants in a zirconia ball and graphite-epoxy disk system.

DETAILED DESCRIPTION OF A PREFERRED EMBODIMENT OF THE INVENTION

Figure 1:
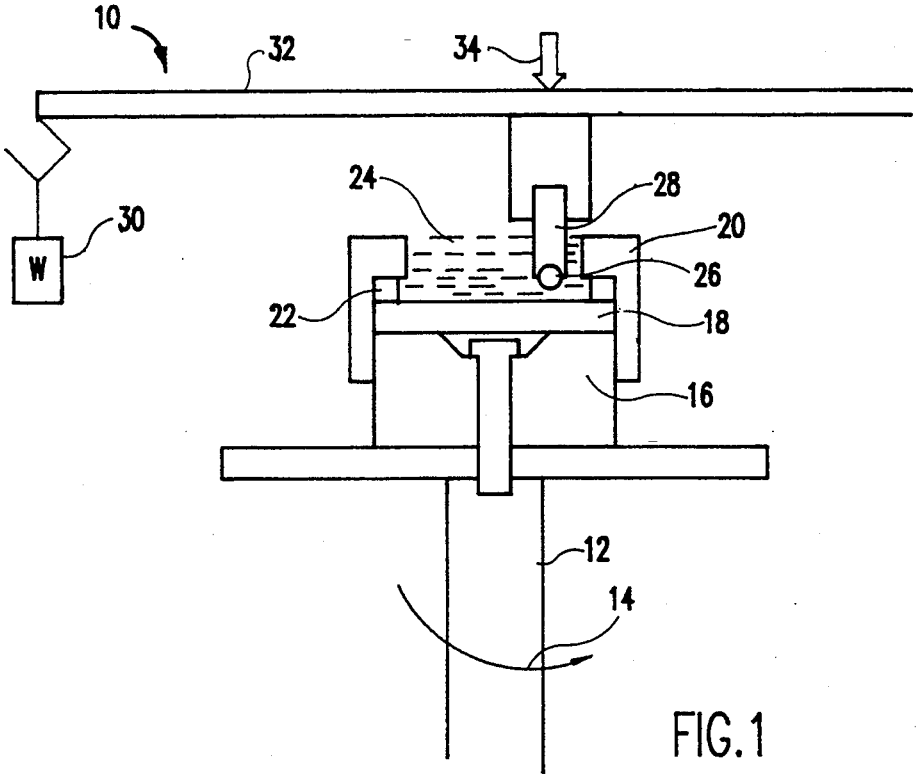
FIG. 1 is a diagram showing an apparatus used to conduct pin-on-disk experiments.

Referring now to the drawings, and more particularly to FIG. 1, there is shown a diagram of a pin-on-disk test apparatus represented generally as 10. The test apparatus 10 includes a table 12 capable of high speed rotation about an axis indicated by arrow 14. The speed of rotation of the table 12 can be accurately regulated by a motor controller. On the table 12 is positioned a vibration isolating platform 16 for holding a ceramic disk 18. The vibration isolating platform 16 may be a rubber material and serves to isolate adverse vibration affects from being transferred from the table 12 to the ceramic disk 18. The ceramic disk 18 is held on the vibration isolating platform 16 by a cylindrical disk holder 20. A rubber washer 22 is placed between the cylindrical disk holder 20 and the ceramic disk 18 so that a lubricant 24 can be held in the volume created by the top portion of the cylindrical disk holder 20 which extends above the ceramic disk 18.

A ceramic ball 26 positioned on the end of a pin 28 contacts the ceramic disk 18 during the experiments. The ceramic ball 26 is firmly secured to the pin 28 during testing by using an epoxy resin; hence, it does not rotate during the test run, rather it slides against the disk 18. Weights 30 hung on the end of a loading arm 32 exert a downward force 34 on the pin 28 which holds the ball 26 in contact with the ceramic disk 18 during a test run. The amount of downward force 34 is controlled by the amount of weight 30 on the loading arm 32, and for these experiments, the downward force 34 was controlled to be five or ten or twenty Newtons (N) depending on the experiment. For example, a force 34 of 20 N gives a calculated mean Hertzian pressure of $2.59*10^9$ N/m$^2$ for alumina-on-alumina for this load and geometry. These are very extreme test conditions which produce contact stresses which equal or exceed those existing critical tribological applications, e.g., gears, cams, and valve lifters in automotive engines, etc. How well the lubricant 24 protects the ceramic disk 18 and the ceramic ball 26 from wear is the primary focus of this invention.

In the experiments reported below in FIGS. 6*a*–6*h*, 7, and 8, new ceramic disks 18 and balls 26 made of alumina were used for each test run. Both alumina disks 18 and balls 26 were of 99.5% purity. Alumina has an elastic modulus of $3.7*10^{11}$ N/m$^2$, a hardness of $1.47*10^{10}$ N/m$^2$, a Poissons ratio of 0.22 a density of 3890 kg/m$^3$, and a thermal conductivity of 35.6 J/(sec)(m)(k). The ceramic disks 18 were 25 mm in diameter. An average of ten measurements indicated that the alumina disks 18 had a surface roughness of 0.73 micrometers. The ceramic balls 26 were grade 5 alumina and were 3.175 mm or one eighth of an inch in diameter. The ceramic disks 18 and balls 26 were ultrasonically cleaned in methanol and then in hexane before each test.

Several lubricant compositions 24 were prepared to determine their ability to reduce the amount of wear on the alumina disk 18 and alumina ball. The lubricant compositions 24 consisted of a hexadecane carrier fluid together with one of the additives shown in FIGS. 6*a*–6*h*, 7, or 8. The additives were selected as monomers capable of forming polymer compounds. The monomers did not polymerize in solution and were either dissolved in, partially dissolved, or dispersed in the hexadecane carrier fluid. The lubricant compositions 24 were all prepared as one percent by weight solutions in hexadecane, except as otherwise specified. Hexadecane is a pure, well-defined carrier fluid of known chemical structure and was selected for its relatively inert characteristics for test purposes. The function of the carrier fluid, of course, is to get the monomer compounds onto the surface of the ceramic element. Therefore, any suitable carrier fluid, such as a mineral oil, a hydrocarbon fuel, a synthetic oil, or even air where the monomers are applied to the ceramic as a vapor, is deemed to be within the scope of the present invention. Obviously, one would select carrier fluids of proper volatility, boiling point, chemical reactivity, etc., for the specific application. Most of the compositions 24 prepared were clear and colorless except the composition with the 4-vinylbiphenyl additive was brown, the composition with the 2-vinylnaphthalene additive was red, the composition with the 9-vinylanthracene additive was yellow, and the composition with the vinyl ferrocene was amber. Most of the additive compounds were soluble in hexadecane; however, 2-vinylnaphthalene, acrylamide, methacrylamide, and methyl-2-acrylamido-2-methoxyacetate were only partially soluble.

In each experiment, 0.7 ml of the lubricant composition 24 was placed in the volume created by the cylindrical disk holder 20 before the ball 26 was brought into contact with the disk 18. The ball 26 contacts the disk 18 at a point 8 mm from the center of the disk 18 and creates a channel in the disk 18 as it wears. When the table 12 has a rotational speed of 300 revolutions per minute (rpm), the ceramic disk 18 has velocity of 0.251 m/s. During each test run, the machine was started with a constant speed of 300 rpm and run for thirty three minutes which gave a sliding distance of the ball 26 relative to the disk 18 of 500 meters.

Figure 2A:
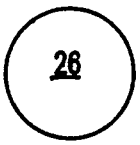
FIGS. 2*a* and 2*b* are before and after cross-sectional side views, respectively, of a ceramic pin used in the pin-on-disk apparatus of FIG. 1.
Figure 2B:
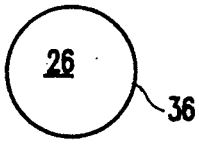
Figure 3:
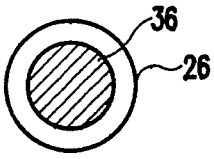
FIG. 3 is a front view of the pin shown in FIG. 2*b* illustrating the worn portion of the pin.
Figure 4A:
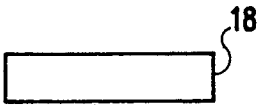
FIGS. 4*a* and 4*b* are before and after cross-sectional side views, respectively, of a ceramic disk used in the pin-on-disk apparatus of FIG. 1.
Figure 4B:
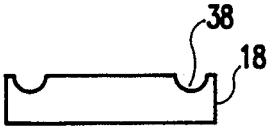
Figure 5A:
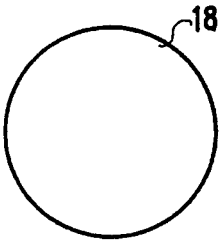
FIGS. 5*a* and 5*b* are before and after top views, respectively, of the ceramic disk shown in FIGS. 4*a* and 4*b;*
Figure 5B:
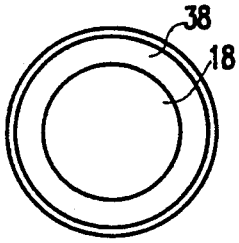

FIGS. 2*a* and 2*b* show the ball 26 before and after a thirty three minute test run, respectively. Note that the ball 26 has been worn down to a level 36 via the sliding contact with the disk 18. FIG. 3 shows that the level 36 is a circular area on the face of the spherical ball 26. By determining the area, the volume of the spherical ball 26 which has been worn away during the test run can be calculated using well known techniques. FIGS. 4*a* and 5*a* show a ceramic disk 18 before a thirty three minute test run and FIGS. 4*b* and 5*b* show the ceramic disk 18 after the test run. Channel 38 is worn into the ceramic disk 18 at the point the ball 25 contacts the disk 18 while it is rotated. By determining the area of a cross-section of the channel 38 and determining the radius of the channel 38, the volume of the channel 38 can be calculated by well known techniques. A photomacroscope and stylus profilometer were used to make the necessary measurements on the ceramic disk 18 and ceramic ball 26.

FIGS. 6*a*–6*h* show the pin-on-disk test results for an alumina-on-alumina system wherein the lubricant compositions tested contained one percent by weight (1 wt %) of several addition type monomers dissolved in a hexadecane carrier fluid. In the experiments, the alumina-on-alumina system was subjected to 20 newtons (N) of force. The wear on the disk 18 and the wear on the ball 26 were determined by photomacroscopic and profilometric techniques and reported in volume units. The two volumes were added together to determine a total volume worn away. The total volume worn away from the ceramic disk and ceramic ball when a test lubricant composition containing one percent by weight of a monomer was used was then compared to the total volume worn away from a ceramic disk and a ceramic ball when hexadecane, without a monomer additive, was used as the lubricant. When pure hexadecane without a monomer additive was used as the lubricant the average worn volume of the alumina disk was $360*10^{-3}$ $mm^3$ and the average worn volume of the alumina ball was $109*10^{-3}$ $mm^3$, so the average total worn volume for the alumina-on-alumina system for hexadecane without a monomer additive was $469*10^{-3}$ $mm^3$. Therefore, the percentage reductions in wear for the alumina disks and balls reported in FIGS. 6*a*–*h* is a direct result of having the monomer in solution with the hexadecane carrier fluid. It is noted that a 50% reduction in wear means that the life of the ceramic part will be doubled, a 67% reduction in wear means tripling the life, and an 80% reduction in wear is equivalent to increasing the wear life of a ceramic element by a factor of five (e.g., 500% increase in life expectancy). Hence, the results reported below have significant life increasing implications for ceramic systems.

Figure 6B:
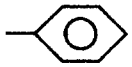
Figure 6B:
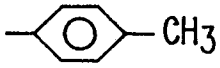
Figure 6B:
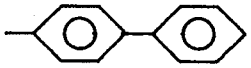
Figure 6B:
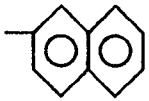
Figure 6B:
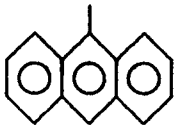

FIG. 6*a* shows that a fluid composition containing addition type monomers of the general structure $CH_2{=}CHX$ and having an ethylene end unit and an aliphatic side chain can reduce ceramic wear. Specifically, a fluid composition containing 1 wt % of 1-dodecene or 1-hexadecene or 1-octadecene dissolved in a hexadecane carrier fluid can result in a significant reduction in wear for rubbing alumina components over that which can be achieved with the hexadecane carrier fluid alone. FIGS. 6*b* and 6*c* show that all of the fluid compositions containing 1 wt % solutions of vinyl aromatic monomers and vinyl acrylate monomers in a hexadecane carrier fluid which were tested in these experiments were very effective for reducing wear. FIG. 6*b* specifically shows that solutions containing 1 wt % of either styrene, 4-vinylbiphenyl, or 2-vinylnaphthalene could be expected to double the life of alumina parts in a ceramic system and FIG. 6*c* specifically shows that solutions containing 1 wt % of either n-butyl methacryate, lauryl methacrylate, or iso-decyl acrylate could be expected to triple the life of alumina parts in a ceramic system.

Figure 6E:
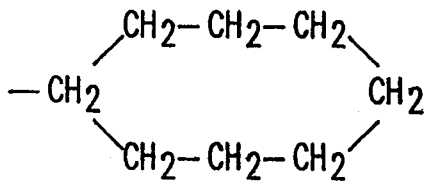
Figure 6E:
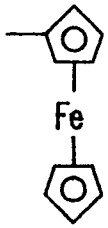

FIG. 6*d* shows that the compositions containing 1 wt % vinyl acetate or 1 wt % vinyloctadecyl ether dissolved in hexadecane were extremely effective in reducing ceramic wear. Specifically, the 1 wt % vinyl acetate solution reduced wear by 70% and the 1 wt % vinyloctadecyl ether solution reduced wear by 74%. As pointed out above, reducing ceramic wear by greater than 67% indicates that the life of the ceramic part will be increased by greater than 300%. FIGS. 6*d* and 6*h* show that solutions containing 1 wt % acrylamide or methacrylamide in hexadecane were ineffective at reducing ceramic wear over that which was achieved with hexadecane alone. FIG. 6*e* shows that both solutions containing 1 wt % vinyl cyclooctane or 1 wt % vinyl ferrocene dissolved in hexadecane were very effective in reducing wear in the alumina-on-alumina pin-on-disk experiments.

Figure 6F:
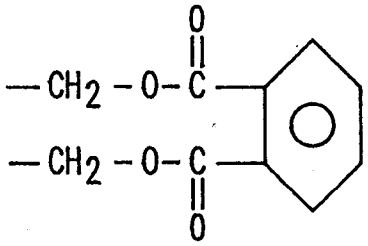
Figure 6F:
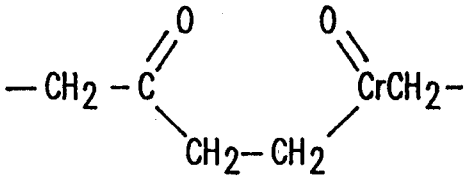

FIG. 6*f* shows the results for alumina-on-alumina pin-on-disk experiments for solutions containing monomers capable of addition type polymerization wherein the monomers have a $CH_2{=}CH{-}X{-}CH{=}CH_2$ structure and are different from those reported in FIGS. 6*a*–*e* in that the monomers discussed in FIG. 6*f* have vinyl groups at each end of the molecule and the monomers discussed in FIGS. 6*a–e* only have one vinyl group at one end of the molecule. In particular, FIG. 6*f* shows that hexadecane solutions containing 1 wt % diallyl phthalate or 1 wt % diallyl succinate were very effective at reducing ceramic wear.

Figure 6G:
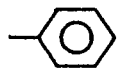
Figure 6H:
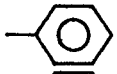
Figure 6H:
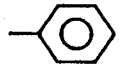
Figure 6H:
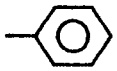
Figure 6H:
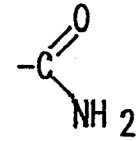

FIGS. 6*g* and 6*h* show the test results for pin-on-disk experiments in an alumina-on-alumina system where the lubricant compositions included monomer additives capable of polymerizing by an addition type mechanism dissolved in hexadecane where the monomers each had more than one constituent connected to the vinyl group. FIG. 6*g* shows that the fluid composition containing 1 wt % trans $\beta$-methylstyrene dissolved in hexadecane actually significantly increased wear on the rubbing alumina elements over the wear which occurs when hexadecane alone is used as the lubricant. However, when compositions containing a 1 wt % monomer additive which had constituents connected to the vinyl group in the cis configuration, i.e., cis-11-hexadecene-1-ol and cis-11-hexadecen-1yl-acetate, were tested in the pin-on-disk experiments, significant wear reduction was achieved, e.g., 43% and 45% wear reduction over an alumina-on-alumina system in which hexadecane alone is utilized, respectively. The difference in the ability of the monomers to reduce wear may be the result of cis bonded molecules interfacing with the ceramic better than trans bonded molecules. FIG. 6*h* shows that effective wear reduction can be achieved with some compositions that contain monomers having two constituents connected to the same carbon of the vinyl group, i.e., effective alumina wear reduction was achieved using the fluid compositions containing either 1 wt % 1,1-diphenylethylene or 1 wt % $\alpha$-methyl styrene dissolved in hexadecane.

Figure 7:
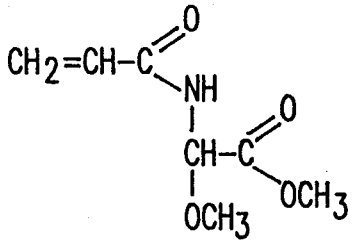
FIG. 7 is a table showing the experimental results for different concentrations of methyl-2-acrylamido-2-methoxyacetate in alumina-on-alumina pin-on-disk experiments.

FIG. 7 shows alumina-on-alumina pin-on-disk test results for a composition containing 1 wt % methyl-2-acrylamido-2-methoxyacetate dissolved in hexadecane. In the experiments, the alumina-on-alumina system was subjected to 20 N of force. Three different compositions were prepared, i.e., 0.02%, 0.10% and 1.00% by weight solutions of methyl-2-acrylamido-2-methoxyacetate in hexadecane, respectively, and tested for their wear reducing properties. As can be seen from FIG. 7, methyl-2-acrylamido-2-methoxyacetate is particularly effective at reducing wear in an alumina-on-alumina system, e.g., even at concentrations as low as 0.02 wt % wear was reduced by more than 80%.

Figure 8B:
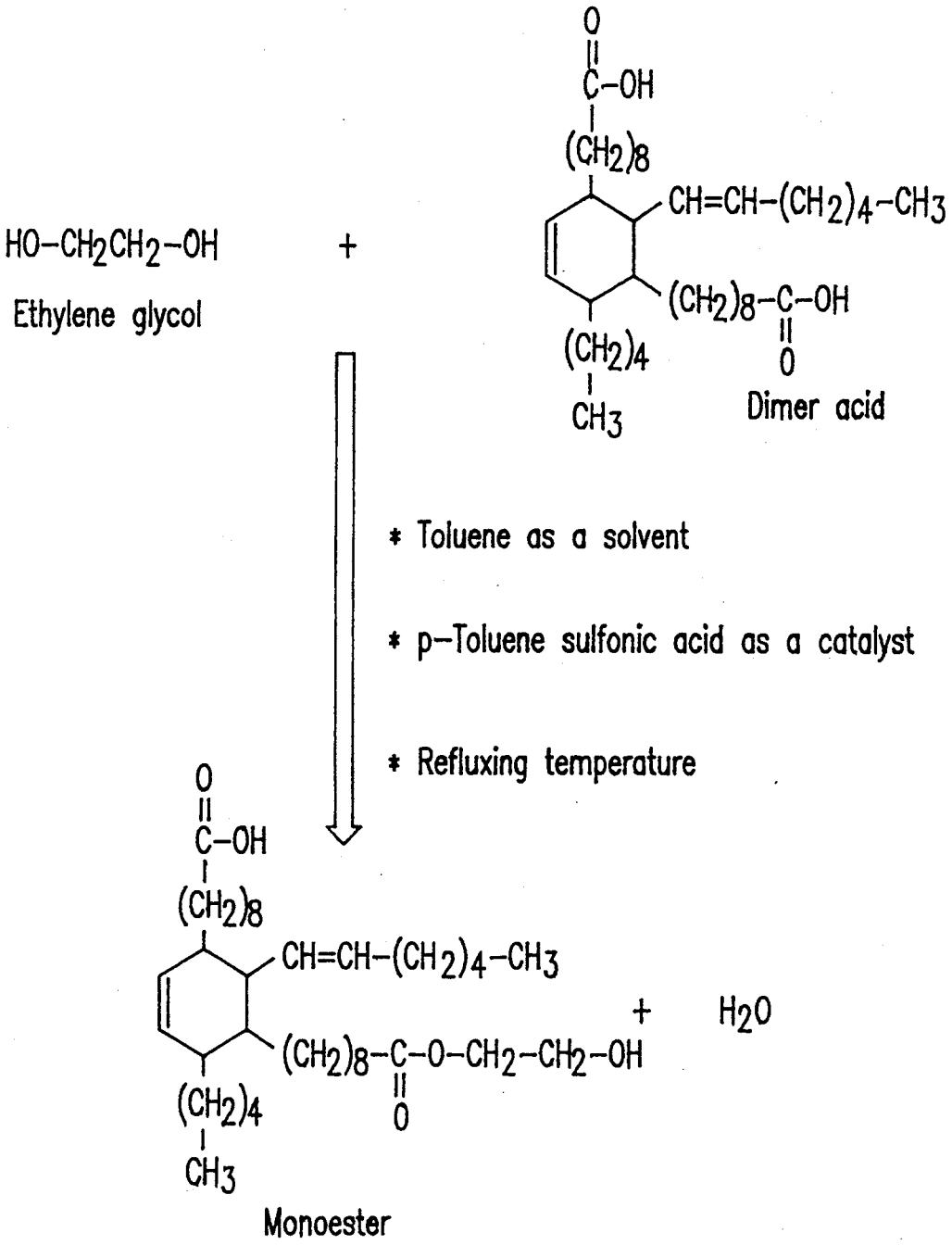
FIG. 8*b* is a reaction scheme for the synthesis of the monoester of $C_{36}$ dimer acid and ethylene glycol.

FIG. 8*a* shows experimental pin-on-disk results in an alumina-on-alumina system where the lubricant comprised 1 wt % of the $C_{36}$ dimer acid and ethylene glycol monoester dissolved in hexadecane and where the force on the rubbing surfaces varied from 5 to 20 newtons (N). The $C_{36}$ dimer acid and ethylene glycol monoester has the general structure of HOOC—R—OH where R contains thirty eight carbon atoms. The $C_{36}$ dimer acid and its reaction with ethylene glycol to form the monoester is discussed in U.S. Pat. No. 3,180,832 to Furey et al. and in U.S. Pat. No. 3,429,817 to Furey et al. and those patents are herein incorporated by reference. The synthesis of the $C_{36}$ monoester is generally diagrammed in FIG. 8*b* wherein the reaction is monitored by the amount of water produced and by the observation of FTIR absorption intensities of ester and acid carbonyl bands. FIG. 8*a* shows that the monoester is more effective in reducing wear at the highest load. Possibly higher surface temperatures are produced in the contact zone at the higher loads and these higher temperatures aid in "in situ" polymerization.

A pin-on-disk experiment using a 1 wt % solution of the $C_{36}$ dimer acid and ethylene glycol monoester dissolved in hexadecane as a lubricant for a sapphire-on-sapphire system (single crystal, polished balls and optical flat disks) was conducted at a load of 10 N at a 300 rpm rotation speed for 1 hr. In the experiments, the coefficient of friction for various systems, with and without lubricants, were determined. Table 1 shows the effect of fluids on friction in the sapphire-on-sapphire system:

TABLE 1

| Fluid | COEFFICIENT OF FRICTION Average | Maximum |
|---|---|---|
| None (dry) | 0.34 | 0.58 |
| distilled $H_2O$ | 0.20 | 0.49 |
| Hexadecane | 0.17 | 0.22 |
| Hexadecane + 1% $C_{36}$ dimer acid/ethylene glycol monester | 0.09 | 0.14 |

Table 1 shows that the presence of hexadecane between the sapphire elements significantly decreases friction over dry systems and that the hexadecane and 1 wt % $C_{36}$ monoester solution had an even lower coefficient of friction. As discussed above in conjunction with FIG. 8*a*, the presence of the $C_{36}$ dimer acid/ethylene glycol monoester in the hexadecane will result in reducing sapphire wear over that which can be achieved with hexadecane alone. An interesting result from this study was that when distilled water was used as the lubricant, nearly twenty times as much wear was experienced by the sapphire ball relative to the dry system, e.g., $380*10^{-3}$ mm$^3$ in dry case and $7600*10^{-3}$ mm$^3$ when water was used.

An additional experiment using a 1 wt % solution of the $C_{36}$ dimer acid and ethylene glycol monoester dissolved in hexadecane as a lubricant for a sapphire-on-sapphire system was conducted at double the load or 20N in the pin-on-disk environment for one hour. Table 2 shows the average ball volume worn away:

TABLE 2

Pin-On-Disk Tests at 20 N Load for 1 Hour

| Additive in Hexadecane | Average Ball Wear Volume in $10^{-3}$ mm$^3$ |
|---|---|
| None | 840 |
| 1% $C_{36}$ dimer acid/ethylene glycol monoester | 200 |

The solution containing $C_{36}$ dimer acid/ethylene glycol monoester dissolved in hexadecane allowed significantly less wear to occur on the sapphire ball. The results in Table 2 demonstrate that tribopolymerization is a very effective approach to lubricating ceramics.

In addition to the alumina-on-alumina systems, where wear reduction results were reported in conjunction with FIGS. 6*a–h*, 7*a–b*, and 8*a–b*, and the sapphire-on-sapphire systems where wear reduction results are reported in Table 2, pin-on-disk experiments have been conducted in a zirconia-on-zirconia ($ZrO_2$-on-$ZrO_2$) system and in a silicon nitride-on-silicon nitride ($Si_3N_4$-on-$Si_3N_4$) system. In the $ZrO_2$-on-$ZrO_2$ experiments, the zirconia balls made of pure $ZrO_2$ stabilized form SZY—H and were grade 10. In the $Si_3N_4$-on-$Si_3N_4$ experiments, the balls were the SAN-2 type, grade 25.

The conditions for the pin-on-disk experiments in both the $ZrO_2$-on-$ZrO_2$ and $Si_3N_4$-on-$Si_3N_4$ systems were a 20Newton load and rotation of the disk at 300 rpm (0.25 meters/second (m/s) for 33 minutes for a total sliding distance of 500 meters. In these experiments, only the average ball wear was measured since the disk wear was low and difficult to measure accurately. The volume of the ball worn away when hexadecane alone was used as the lubricant in the $ZrO_2$-on-$ZrO_2$ system was $1.73*10^{-3}$ $mm^3$. The volume of the ball worn away when hexadecane alone was used as the lubricant in the $Si_3N_4$-on-$Si_3N_4$ sytem was $1,113*10^{-3}$ $mm^3$. It should be noted that $Si_3N_4$ has become an important engineering material because of its inherent low wear properties and that in these pin-on-disk experiments the $Si_3N_4$ ball had much less wear than alumina and less wear than zirconia when hexadecane alone was used as the lubricant.

FIG. 9 reports the percentage reduction in wear for the zirconia ball when fluid compositions containing 1 wt % of a monomer dissolved in hexadecane were used as the lubricants. Like the experiments described above, the percentage reduction in wear is the result of the comparison of the volume worn away when hexadecane alone is used as the lubricant in the zirconia-on-zirconia system to the volume worn away when the composition containing the monomer dissolved in hexadecane is used as the lubricant. FIG. 9 shows that all lubricant solutions tested were able to reduce wear in the zirconia-on-zirconia system. In particular, solutions containing either 1 wt % vinyl octadecyl ether or 1 wt % lauryl methacrylate dissolved in hexadecane were able to reduce wear by as much as 45%. 11-amino undecanoic acid was only partly soluble in hexadecane, yet the 1 wt % solution of 11-amino undecanoic acid was able to reduce wear of the ceramic ball by 29% over that where hexadecane alone was used as the lubricant. The $C_{36}$ dimer acid/ethylene glycol monester and the 11-amino undecanoic acid are examples of monomers capable of condensation type polymerization and the 1-dodecene, 1-eicosene, lauryl methacrylate, diallyl phthalate, and vinyl octadecyl ether are examples of monomers capable of addition type polymerization.

FIG. 10 reports the percentage reduction in wear for the silicon nitride ball when fluid compositions containing 1 wt % of a monomer dissolved in hexadecane were used as the lubricant. Like the experiments described above, the percentage reduction in wear is the result of the comparison of the volume worn away when hexadecane alone is used as the lubricant in the $Si_3N_4$-on-$Si_3N_4$ system to the volume worn away when the composition containing the monomer dissolved in hexadecane is used as the lubricant. FIG. 10 shows that solutions containing either 1 wt % diallyl phthalate or 1 wt % 11-amino undecanoic acid dissolved in hexadecane were able to reduce wear by approximately half; therefore, use of these lubricant solutions could double the life of ceramic machines which utilize silicon nitride. In addition, FIG. 10 shows that solutions containing either 1 wt % $C_{36}$ dimer acid/ethylene glycol monoester or 1 wt % methyl-2-acrylamido-2-methoxy acetate dissolved in hexadecane were able to reduce wear by an impressive 72% or 65%, respectively; therefore, use of these lubricant solutions could effectively triple the life of ceramic machines which utilize silicon nitride. These are the only experiments known by the inventor which demonstrate lubricant solutions which can significantly reduce the wear of silicon nitride which itself is a low-wear ceramic material. Because silicon nitride is an expensive material and is used in very hostile environments because of its low-wear properties, lubricant solutions which can increase the life of silicon nitride should be extremely useful.

In a totally different high-contact stress system designed to study fretting wear and fretting corrosion, additional experiments were carried out using zirconia balls on graphite-epoxy flat disks. Fretting is a form of wear which occurs when two bodies in contact undergo vibratory/oscillatory motion. Fretting is important in joints, fastenings, bearing supports, and a wide variety of "stationary" contact situations. In the experiments, fretting tests were conducted at three different normal loads, i.e., 40 N, 90 N, and 130 N in the zirconia/graphite-epoxy system. The frequency of oscillation was 50 Hz and the amplitude was set at 200 microns (peak to peak). The tests were conducted for one hour or 180,000 cycles. The composite specimens were made by laying up prepreg layers of graphite-epoxy in an alternating orientation, e.g., zero and ninety degrees. The zirconia balls were five eighths of an inch in diameter and were grade 10. The zirconia balls were loaded and oscillated against the composite in the anti-parallel direction. Friction was measured and recorded by means of a strain gauge ring and wear on the composite was determined by photomacrography.

FIG. 11 shows the fretting test results at different applied loads in the zirconia/graphite-epoxy system where hexadecane alone and a composition of hexadecane and 1 wt % $C_{36}$ dimer acid/ethylene glycol monoester were used as the lubricants. The addition of the 1% of monoester resulted in a reduction in disk wear of as much as 48%. Furthermore, at the higher load (130 N), the monoester was more effective at wear reduction. Greater wear reduction with increasing load may be the result of increased surface temperatures favoring tribopolymerization as discussed above in conjunction with FIG. 8*a*. Effects on friction varied from a slight (5–7%) increase to a 30% decrease depending on the load.

Mixed system fretting experiments were conducted using the fretting machine where the mixed systems included 52100 alloy steel balls ($\frac{5}{8}$ inch in diameter) in oscillating contact against alumina and graphite-epoxy composites. These tests were conducted for one hour at an applied load of 86 N, frequency of 60 Hz, and an amplitude of 225 microns (peak to peak). In the experiments, hexadecane alone and a composition of hexadecane and 1 wt % $C_{36}$ dimer acid/ethylene glycol monoester were used as the lubricants. In the steel-on-alumina system, it was found that the addition of the $C_{36}$ dimer acid/ethylene glycol monoester actually increased friction somewhat, but completely eliminated wear on the steel ball. In the steel-on-graphite system, the hexadecane lubricant was able to lower friction and wear over the unlubricated (dry) case; however, wear on the graphite-epoxy disk was still substantial. When the fluid composition comprised of 1 wt % $C_{36}$ dimer acid/ethylene glycol monoester dissolved in hexadecane was used as the lubricant, no wear on the disk could be detected even under a microscope.

While the invention has been described in terms of its preferred embodiment where compositions containing specific monomer compounds can be used to reduce the wear of rubbing ceramic components, those skilled in the art will recognize that the invention can be practiced with modification within the spirit and scope of the appended claims.

Having thus described our invention, what we claim as new and desire to secure by Letters Patent is the following:

1. A method of reducing ceramic wear, comprising the steps of:

providing a ceramic material having a surface which will be exposed to rubbing contact with another material; and appying a ceramic lubricating composition to said surface which will be exposed to rubbing contact with another material, said ceramic lubricating composition comprising 90.0%–99.9% by weight of a carrier fluid selected from the group consisting of mineral oils, hydrocarbon fuels, synthetic oils and hexadecane, and 0.01–10% by weight of methyl-2-acrylamido-2-methoxyacetate dissolved or dispersed in said carrier fluid, said ceramic lubricating composition reducing wear of said ceramic material at said surface exposed to rubbing contact.

2. A method as recited in claim 1 wherein said ceramic material is selected from the group consisting of alumina, zirconia, and silicon nitride.

3. A method as recited in claim 1 wherein said methyl-2-acrylamido-2-methoxyacetate is present in said composition at a level ranging from 0.1–1.0% by weight.

4. A method of reducing ceramic wear, comprising the steps of:

providing a ceramic material having a surface which will be exposed to rubbing contact with another material; and applying a ceramic lubricating composition to said surface which will be exposed to rubbing contact with another material, said ceramic lubricating composition comprising 90.0%–99.9% by weight of a carrier fluid selected from the group consisting of minneral oils, hydrocarbon fuels, synthetic oils, and hexadecane, and 0.01–10% by weight of an acrylate monomer selected from the group consisting of n-butyl methacrylate, lauryl methacrylate, and isodecyl acrylate, said acrylate monomer dissolved or dispersed in said carrier fluid, said ceramic lubricating composition reducing wear of said ceramic material at said surface exposed to rubbing contact.

5. A method as recited in claim 4 wherein said ceramic material is selected from the group consisting of alumina, zirconia, and silicon nitride.

6. A method of reducing ceramic, wear, comprising the steps of:

providing a ceramic material having a surface which will be exposed to rubbing contact with another material; and applying a ceramic lubricating composition comprising 90.0–99.9% by weight of a carrier fluid selected from the group consisting of mineral oils, hydocarbon fuels, synthetic oils, and hexadecane, and 0.01–10% by weight of a monomer selected from the group consisting of 1-dodecene, 1-hexadecene, 1-octadecene, styrene, 4-methyl styrene, 4-vinylbiphenyl, 2-vinylhaphthalene, 9-vinylanthracene, n-butyl methacrylate, lauryl methacrylate, n-octadecylmethacrylate, iso-decyl acrylate, vinyl acetate, vinyl 2-ethylhexanoate, vinyl stearate, vinyl octadecyl ether, vinyl cyclooctane, vinyl ferrocene, diallyl phthalate, diallyl succinate, cis-11-hexadecene-1-yl-acetate, cis-11-hexadecene-1-ol, oleyl alcohol, 1,1-diphenylethylene, and α-methylstyrene.

7. A composition, comprising:

90–99.9% by weight of a carrier fluid selected from the group consisting of mineral oils, hydrocarbon fuels, synthetic oils, and hexadecane; and 0.01–10.0% by weight of methyl-2-acrylamido-2-methoxyacetate dissolved or dispersed in said carrier fluid.

8. A composition, comprising:

90–99.9% by weight of a carrier fluid selected from the group consisting of mineral oils, hydrocarbon fuels, synthetic oils, and hexadecane; and 0.01–10.0% by weight of an acrylate monomer selected from the group consisting of n-butyl methacrylate, lauryl methacrylate, and isodecyl acrylate, said acrylate monomer dissolved or dispersed in said carrier fluid.

* * * * *